US005905355A

United States Patent [19]

Fulks et al.

[11] Patent Number: 5,905,355

[45] Date of Patent: May 18, 1999

[54] PUMP-MOTOR APPARATUS

[75] Inventors: Gary Chris Fulks, Dayton; Michael Anthony Dimatteo, Kettering; William Charles Kruckemeyer, Beavercreek, all of Ohio

[73] Assignee: General Motors Corporation, Detroit, Mich.

[21] Appl. No.: 08/835,337

[22] Filed: Apr. 7, 1997

[51] Int. Cl.[6] ..... H02P 1/46

[52] U.S. Cl. ..... 318/701; 318/700; 318/715

[58] Field of Search ..... 318/689, 696, 318/715, 701; 175/45; 16/198; 418/14; 60/602; 251/58; 417/353; 303/162

[56] References Cited

U.S. PATENT DOCUMENTS

| | | | |
|---|---|---|---|
| 4,758,132 | 7/1988 | Hartwig | 417/353 |
| 5,180,960 | 1/1993 | Austermann | 318/701 |
| 5,296,793 | 3/1994 | Lang | 318/715 |
| 5,355,069 | 10/1994 | Bahn | 318/701 |
| 5,522,653 | 6/1996 | Fulks et al. | 303/162 |
| 5,545,964 | 8/1996 | Stephenson | 318/701 |

*Primary Examiner*—William M. Shoop, Jr.
*Assistant Examiner*—Rita Leykin
*Attorney, Agent, or Firm*—Anthony L. Simon

[57] ABSTRACT

A pump-motor apparatus comprising: a pump having an input shaft for receiving motive force to operate the pump, wherein during rotation of the input shaft, the pump exhibits repeating cyclical first torque variations on the input shaft, said first torque variations including cyclical torque peaks and torque dips and occurring in substantially evenly spaced increments in angular position of the input shaft; and an electric drive motor having an output shaft coupled to and driving the input shaft, wherein the electric drive motor exhibits on the output shaft repeating cyclical second torque variations, said second torque variations including cyclical torque peaks and torque dips and occurring in substantially evenly spaced increments in angular position of the output shaft, wherein the substantially evenly spaced increments in angular position of the output shaft are equal to the substantially evenly spaced angular increments in position of the input shaft, wherein torque peaks and dips of the output shaft second torque variations are aligned with the torque peaks and dips of the input shaft first torque variations.

4 Claims, 2 Drawing Sheets

PUMP-MOTOR APPARATUS

TECHNICAL FIELD

This invention relates to a pump motor apparatus.

BACKGROUND OF THE INVENTION

Many commercially available fluid pumps are designed to be driven by an electric motor. For pumps such as axial piston pumps, when the input shaft is driven at a constant velocity, the pump typically exerts a cyclically varying torque load on the input shaft. That is, with each rotation of the input shaft, the torque required to keep the shaft moving at the constant velocity cyclically rises and falls.

An electric motor for driving the pump is required to provide, at its minimum torque output, a torque greater than the maximum torque required by the pump. This ensures that the electric motor will always have sufficient torque output to drive the pump at the desired power level. Failure to ensure that the motor torque is sufficiently large results in stalling of the motor and pump unit during high hydraulic load conditions at both high and low rotational velocities of the motor. Stalling of the motor at high rotational velocities may sometimes be overcome using a high inertia rotor motor. However such motors are generally heavier and less efficient than low inertia motors and system designers typically prefer low inertia motors where system weight and efficiency are important.

SUMMARY OF THE PRESENT INVENTION

It is an object of this invention to provide a pump-motor apparatus.

Advantageously, this invention provides a pump motor apparatus in which a pump with cyclically repeating torque peaks is driven by an electric motor in a manner with improved efficiency. Advantageously, this invention allows use of a low inertia electric drive motor requiring less power than previous motor and pump systems while ensuring robust operation of the pump.

Advantageously, this invention recognizes that the cyclical torque variations of a pump such as the axial piston pump enable implementation of an electric motor design to increase efficiency over prior electric drive motor and pump systems. More particularly, this invention recognizes that the cyclical nature of the torque variations of the pump motor have a regular and repeating character. Thus, this invention advantageously utilizes the regular and repeating character in the design of the drive motor for the pump so that the drive motor output torque also exhibits regular and repeating torque variations. The drive motor and pump shafts are properly aligned and connected together so that, when the pump input shaft is at an angular position where the required torque is at a cyclical low point, the drive motor's drive torque is also reduced, and when the pump input shaft is at an angular position where the required torque is at a cyclical high peak, the drive motor's drive torque is increased.

Advantageously, in a preferred example, the cyclical torque output of the electric drive motor is achieved through the physical structure of the electric drive motor and not through complex controls of the power supplied to the motor.

Advantageously, according to a preferred example of this invention, it is recognized that, like certain pumps, switched reluctance motors themselves exhibit repetitive, positional and cyclical torque output variations. Furthermore, the repetitive, positional and cyclical torque output variations of the switched reluctance motor can be designed to match the cyclical torque requirements of the pump so that drive torque peaks required by the pump correlate positionally with output shaft torque peaks of the switched reluctance motor. Advantageously, this invention allows implementation of a switched reluctance motor to drive a fluid pump having cyclical, positional torque variations and allows the minimum torque of the switched reluctance motor to be less than the maximum torque required by the pump. Through this invention, a smaller torque output switched reluctance motor can be used to drive the same pump previously requiring a larger torque output motor. By using the smaller motor, this invention realizes a savings in the amount of power required by the drive motor for the pump. Such savings can be on the order of a fifteen percent (15%) reduction in power consumption.

Advantageously, according to a preferred example, this invention provides a pump-motor apparatus comprising: a pump having an input shaft for receiving motive force to operate the pump, wherein during rotation of the input shaft, the pump exhibits repeating cyclical first torque variations on the input shaft, said first torque variations including cyclical torque peaks and torque dips and occurring in substantially evenly spaced increments in angular position of the input shaft; and an electric drive motor having an output shaft coupled to the input shaft, wherein the electric drive motor exhibits on the output shaft repeating cyclical second torque variations, said second torque variations including cyclical torque peaks and torque dips and occurring in substantially evenly spaced increments in angular position of the output shaft, wherein the substantially evenly spaced increments in angular position of the output shaft are equal to the substantially evenly spaced angular increments in position of the input shaft, wherein torque peaks and dips of the output shaft second torque variations are aligned with the torque peaks and dips of the input shaft first torque variations.

Advantageously, according to another preferred example, this invention provides a pump-motor apparatus comprising: a fluid pump having an input shaft, wherein the pump exhibits input shaft torque variation in a repetitive cycle with rotation of the drive shaft, wherein, during each rotation of the drive shaft, the pump exhibits m substantially equally angularly spaced first torque peaks; and a switched reluctance motor comprising a stator, a rotor and an output shaft coupled to the rotor, wherein the stator includes a first set of selectively energizable poles and the rotor includes a second set of soft magnetic poles, wherein, during a complete rotation of the output shaft, m alignments occur between at least one energizable pole of the stator and at least one soft magnetic pole of the rotor, wherein the m alignments create m substantially equally angularly spaced second torque peaks on the output shaft, wherein the output shaft is coupled to the input shaft with the m substantially equally angularly spaced first torque peaks aligned with the m equally angularly spaced second torque peaks, wherein a pump-motor apparatus with improved efficiency is provided.

BRIEF DESCRIPTION OF THE DRAWINGS

The present invention will now be described by way of example with reference to the following drawings in which.

DETAILED DESCRIPTION OF THE INVENTION

Figure 1:
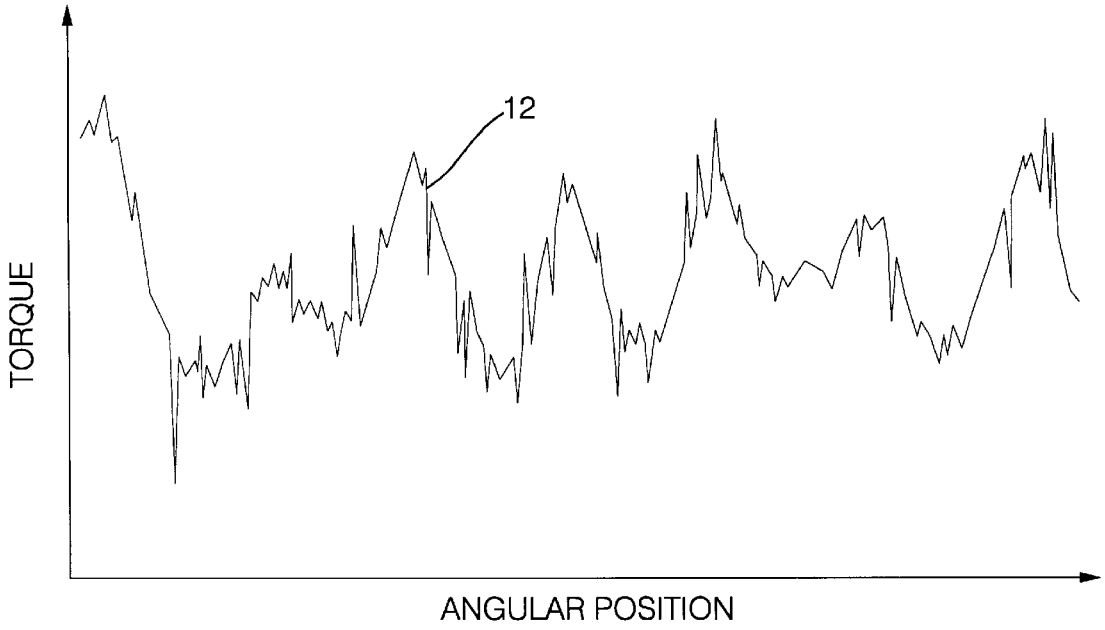
FIG. 1 illustrates an example torque characteristic of a known type of fluid pump.

Referring now to FIG. 1, the trace 12 shown represents the torque load behavior of the input shaft of a commercially available axial piston pump with the input shaft driven at a constant rotational velocity. The input shaft torque, represented by trace 12, is plotted as a function of shaft angular position. As can be seen, the torque on the pump input shaft rises and falls, cyclically peaking at regular increments of angular position of the pump input shaft (i.e., in this example, every $\pi/6$ radians of angular rotation of the input shaft). The torque behavior of the pump repeats with each rotation of the input shaft and the torque peaks occur at the same positions of the input shaft during each rotation. While the torque peaks depend upon hydraulic load on the pump, their occurrence is independent of motor speed the torque peaks occur during pump start-up and during full running of the pump.

Figure 2:
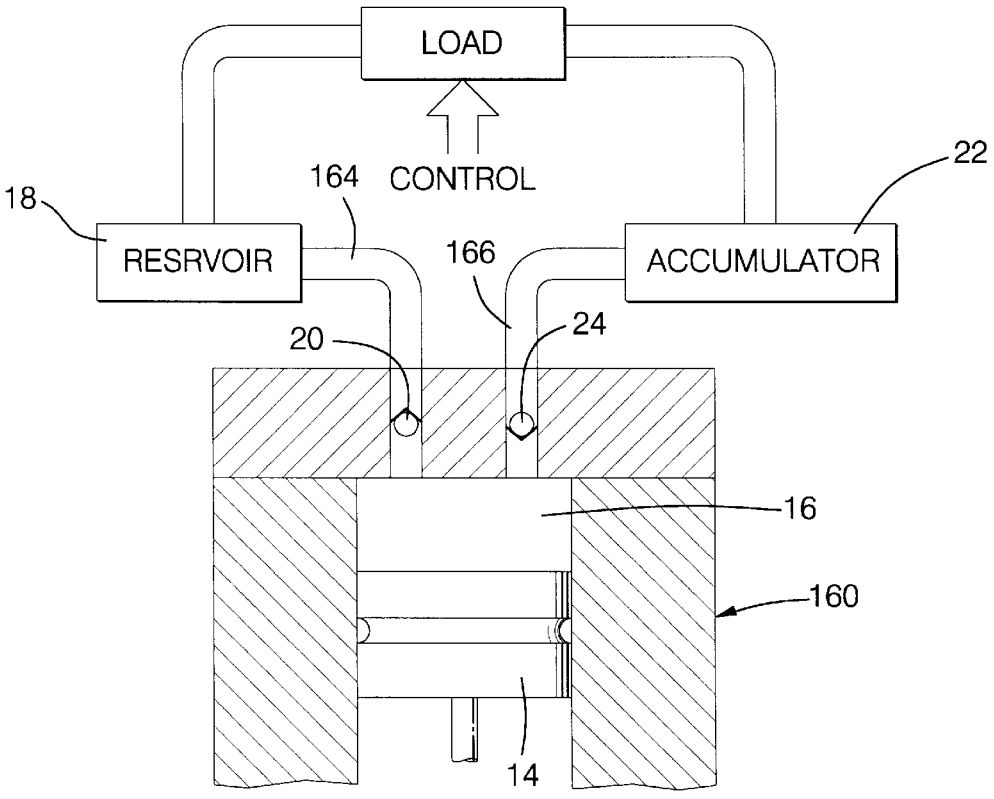
FIG. 2 illustrates schematically example operation of an axial piston pump.

The occurrence of the torque peaks is a function of the operation of the axial piston pump and can be understood now with reference to FIG. 2. More particularly, the axial piston pump 160 has a known type of operation in which a central piston 14 has an intake stroke and an out-take stroke. During the intake stroke, the piston cylinder 16 is valved to the fluid reservoir 18 and fluid is drawn through the piston cylinder intake valve 20 into piston cylinder 16. This part of the piston stroke correlates to a low point in the cyclical pressure cycle shown by trace 12 (FIG. 1) because the reservoir represents a relatively low pressure load on the piston.

During the out-take stroke, the piston cylinder 14 is valved, for example, to the high pressure accumulator 22 and fluid is forced by the piston through the outlet valve 24 into the accumulator 22. This part of the piston stroke correlates to a high torque point in the cyclical torque cycle shown by trace 12 because the piston is exposed to the high pressure of the fluid in the accumulator 22.

Figure 3:
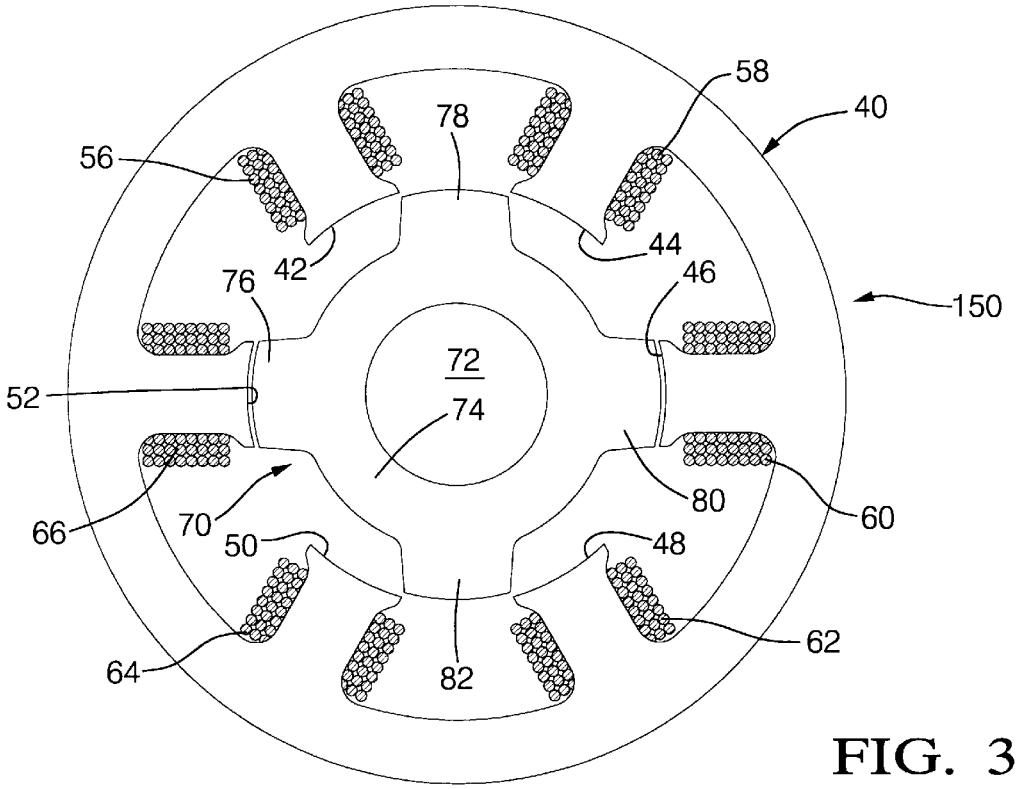
FIG. 3 illustrates an example switched reluctance motor for use with a pump according to this invention.

Referring now to FIG. 3, the motor shown is designed for use with the pump having the input torque characteristic shown in FIG. 1. The motor is a switched reluctance motor designed to have cyclical output torque peaks corresponding to the input shaft torque peaks of the pump, i.e., exhibited by trace 12 in FIG. 1. The motor is coupled to the pump so as to coordinate the output torque peaks of the motor with drive torque requirements of the pump and more efficiently use the motor 150.

More particularly, the motor 150 shown in FIG. 3 includes a stator 40 having, in this example, six stator poles 42–52. Each stator pole 42–52 has an associated phase winding 56–66. The phase windings 56–66 are selectively energized in a known manner of switched reluctance motor control to selectively magnetize the poles 42–52 and cause rotation of the rotor 70.

The rotor 70 comprises drive shaft 72 and pole piece 74. The pole piece 74 is fixedly attached to the drive shaft 72 in a known manner and comprises, in this example, four soft magnetic poles 76–82.

Conventional switched reluctance motor controllers sense the position of the rotor 70 and, responsive thereto, selectively energize the phase coils 56–66 responsive to the sensed position of the rotor 70 to cause the desired movement of the rotor 70 and output shaft 72. Such controllers and control functions are well known to those skilled in the art and need not be set forth herein in detail. It is noted, however, that example switched reluctance motor control apparatuses suitable for use with the motor shown in FIG. 3 are set forth in pending U.S. patent applications, Ser. Nos. 08/449,314 and 08/453,668 and U.S. Pat. No. 5,522,653, all assigned to the assignee of this invention.

In the switched reluctance motor shown in FIG. 3, torque output peaks "m" occur each time the rotor 70 has a pole 76–82 that is about to be aligned with the pole of an energized phase coil 56–66. For example, in FIG. 3, rotor poles 76 and 80 are aligned with poles 52 and 46 on the stator 40. The maximum torque output for the motor shown will occur when poles 76 and 80 are within a few degrees of alignment with the poles 52 and 46 on the stator and the stator coils 60 and 66 are energized. This maximum torque output will occur in the form of a torque peak in the motor output shaft 72 and is repeated with each impending alignment between a rotor pole and a stator pole. Thus, the number of torque peaks in the motor output corresponds to the number of alignments between the soft magnetic poles 76–82 of the rotor and the energized poles 42–52 on the stator.

Figure 4:
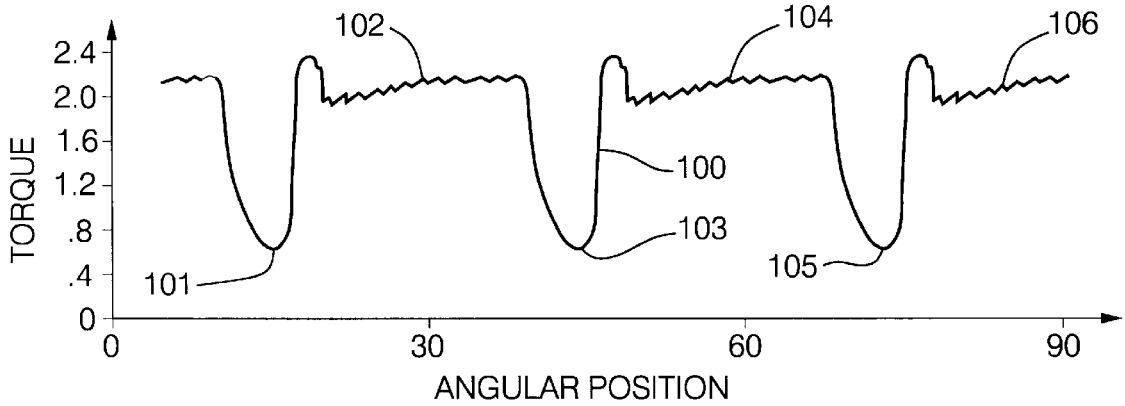
FIG. 4 illustrates cyclical position-varying torque of the output shaft of the example motor shown in FIG. 3.

As will be apparent to those skilled in the art, during each complete rotation of the rotor 70, there occurs 12 alignments between rotor soft poles 76–82 and stator poles 42–52 and the alignments are evenly spaced, occurring every $\pi/6$ radians of angular rotation of the rotor 70. Thus, referring now also to FIG. 4, the trace 100 shows the output torque of the motor shaft 72 in relation to angular position of the rotor 70. Trace 100 has peaks 102, 104 and 106 occurring cyclically with every $\pi/6$ radians of angular rotation of the rotor 70.

The electric motor output shaft is coupled to the input shaft of the pump to drive the pump and the shafts are positioned so that the torque peaks in the output shaft of the motor correspond to the high torque requirement peaks of the input shaft of the pump. For the example shown in FIGS. 1–4, the torque requirement peaks for the input shaft of the pump occur with every $\pi/6$ radians of input shaft rotation and the torque output peaks of the motor occur with every $\pi/6$ radians of rotation of the motor rotor and output shaft. By properly aligning the output shaft 72 of the motor with the input shaft of the pump, the motor output torque peaks are established to occur with the peaks in required input torque of the pump. This allows the cyclical output torque dips 101, 103 and 105 of the motor 150 to reduce the output torque of the motor 150 to values substantially less than the peak torque requirements of the pump input shaft shown by trace 12 in FIG. 1. This is contrary to prior art teachings in which minimum motor output torque must be greater than the maximum input shaft torque required by the pump to prevent stalling of the motor during high hydraulic pump load conditions. This invention provides an increase in efficiency by reducing the power consumption of the motor as much as approximately 15% compared to the prior art.

Figure 5:
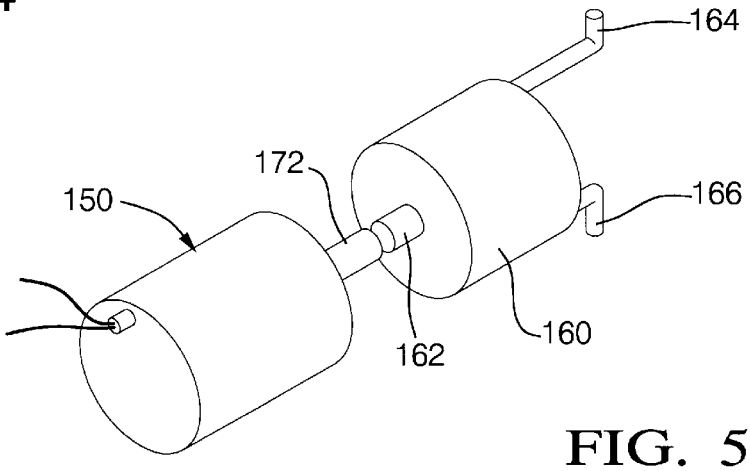
FIG. 5 illustrates an example motor and pump combination according to this invention.

Thus referring now also to FIG. 5, the motor 150 has its output shaft 172 coupled to the input shaft 162 of the pump 160 to draw fluid through the pump inlet 164 and out of the pump outlet 166. The shafts 162 and 172 are preferably keyed or in some other way machined so that when the shafts are engaged, they are automatically positionally aligned as described above.

In the above description of this invention, the example pump has input torque requirement peaks occurring with every $\pi/6$ radians of angular rotation of the input shaft and the switched reluctance motor is configured to have torque output peaks occurring every $\pi/6$ radians of angular rotation of the output shaft. It is recognized that this configuration is an example of this invention and that the number of torque peaks required by the pump may vary with different pumps as long as the peaks are repeatable at evenly spaced positions with each rotation of the pump input shaft. If such condition is met, the switched reluctance motor can be configured with appropriate numbers of stator and rotor poles to match the torque requirement peak spacing of the pump. If desired, incremental or reduction gearing can be placed between the shafts 172 and 162 or between the pump shaft 162 and the pump's internal rotary to linear converter (i.e., crank arm and piston rod, or cam and cam follower, etc.) to properly scale the cyclical torque peaks of the motor 150 and pump 160.

While the above-described preferred example refers to a switched reluctance motor designed as the electric drive motor, other types of motors including brush and brushless dc motors, etc., can be designed to provide the required cyclical torque peaks at the motor output shaft.

We claim:

1. A pump-motor apparatus comprising:

a pump having an input shaft for receiving motive force to operate the pump, wherein during rotation of the input shaft, the pump exhibits repeating cyclical first torque variations on the input shaft, said first torque variations including cyclical torque peaks and torque dips and occurring in substantially evenly spaced increments in angular position of the input shaft; and an electric drive motor having an output shaft coupled to and driving the input shaft, wherein the electric drive motor exhibits on the output shaft repeating cyclical second torque variations, said second torque variations including cyclical torque peaks and torque dips and occurring in substantially evenly spaced increments in angular position of the output shaft, wherein the substantially evenly spaced increments in angular position of the output shaft are equal to the substantially evenly spaced angular increments in position of the input shaft, wherein the torque peaks and dips of the output shaft second torque variations are aligned with the torque peaks and dips of the input shaft first torque variations.

2. A pump-motor apparatus according to claim 1, wherein the electric drive motor is a switched reluctance motor comprising a stator with a first set of stator poles and a rotor with a second set of rotor poles wherein the rotor drives the output shaft of the electric drive motor, wherein, during rotor rotation, an alignment between at least one of the stator poles and at least one of the rotor poles occurs once during each substantially evenly spaced angular positional increment of the output shaft, wherein said alignments create the second torque variations on the output shaft.

3. A pump-motor apparatus according to claim 1, wherein a minimum torque output by the electric drive motor is less than a maximum torque peak on the input shaft of the pump.

4. A pump-motor apparatus comprising:

a fluid pump having an input shaft, wherein the pump exhibits input shaft torque variation in a repetitive cycle with rotation of the drive shaft, wherein, during each rotation of the drive shaft, the pump exhibits m substantially equally angularly spaced first torque peaks; and a switched reluctance motor comprising a stator, a rotor and an output shaft coupled to the rotor, wherein the stator includes a first set of selectively energizable poles and the rotor includes a second set of soft magnetic poles, wherein, during a complete rotation of the output shaft, m alignments occur between at least one energizable pole of the stator and at least one soft magnetic pole of the rotor, wherein the m alignments create m substantially equally angularly spaced second torque peaks on the output shaft, wherein the output shaft is coupled to the input shaft with the m substantially equally angularly spaced first torque peaks aligned with the m equally angularly spaced second torque peaks, wherein a pump-motor apparatus with improved efficiency is provided.

* * * * *